US005099993A

United States Patent [19]

Lewington et al.

[11] Patent Number: 5,099,993

[45] Date of Patent: Mar. 31, 1992

[54] INSECT SCREEN DISPENSING SYSTEM INCLUDING A BOX AND SUPPORT ARRANGEMENT

[75] Inventors: Roger P. Lewington, Campbellville; John D. Hassard, Milton, both of Canada

[73] Assignee: Bay Mills Limited, Ontario, Canada

[21] Appl. No.: 611,449

[22] Filed: Nov. 13, 1990

Related U.S. Application Data

[63] Continuation of Ser. No. 132,006, Dec. 11, 1987, abandoned.

[51] Int. Cl.[5] ..... B65D 85/67

[52] U.S. Cl. ..... 206/409; 206/44 B; 206/391; 206/395; 211/88; 211/106; 225/34; 225/48; 248/220.3

[58] Field of Search ..... 206/45.11, 45.12, 44 R, 206/44 B, 45, 389, 391, 395, 409; 211/78, 88, 106, 133, 181; 225/34, 37, 38, 42, 45, 46, 48, 49; 229/DIG. 2, DIG. 5; 248/220.3, 220.4; 135/904, 87; 160/19, 23 R

[56] References Cited

U.S. PATENT DOCUMENTS

| | | | |
|---|---|---|---|
| 838,517 | 12/1906 | Bowser | 225/38 |
| 915,579 | 3/1909 | Ferres | 229/DIG. 2 |
| 1,449,065 | 3/1923 | Smith | 211/78 |
| 2,214,380 | 9/1940 | Nisbet | 206/391 X |
| 2,327,878 | 8/1943 | Ezrol | 206/395 |
| 2,861,753 | 11/1958 | Sipior . | |
| 2,864,493 | 12/1958 | Holcombe | 206/389 X |
| 2,984,395 | 5/1961 | Catlett et al. | 225/42 |
| 3,092,294 | 6/1963 | Holcombe | 225/48 |
| 3,096,883 | 7/1963 | Llewellyn | 211/88 |
| 3,108,726 | 10/1963 | Hawk | 225/49 |
| 3,237,827 | 3/1966 | Di Pomenice et al. | 225/46 |
| 3,477,624 | 11/1969 | Branyon et al. | 206/395 X |
| 3,516,587 | 6/1970 | Bjorklund | 225/48 |
| 3,517,448 | 6/1970 | Wallace | 312/39 X |
| 3,718,251 | 2/1973 | Barnett | 206/409 X |
| 3,870,212 | 3/1975 | Polk | 225/42 |
| 4,027,795 | 6/1977 | Rigden | 206/409 |
| 4,274,573 | 6/1981 | Finkelstein | 225/48 X |

FOREIGN PATENT DOCUMENTS

| | | | |
|---|---|---|---|
| 886097 | 11/1971 | Canada . | |
| 2632518 | 1/1978 | Fed. Rep. of Germany | 225/37 |
| 2755921 | 6/1979 | Fed. Rep. of Germany | 206/391 |

*Primary Examiner*—Bryon P. Gehman

*Attorney, Agent, or Firm*—Fitzpatrick, Cella, Harper & Scinto

[57] ABSTRACT

A system for dispensing insect screen in retail stores includes a roll of screen, a box having a specially configured slot, and a holder for the box, all arranged such that the screening can be pulled from the box and cut to desired lengths.

14 Claims, 6 Drawing Sheets

Fig. 3.
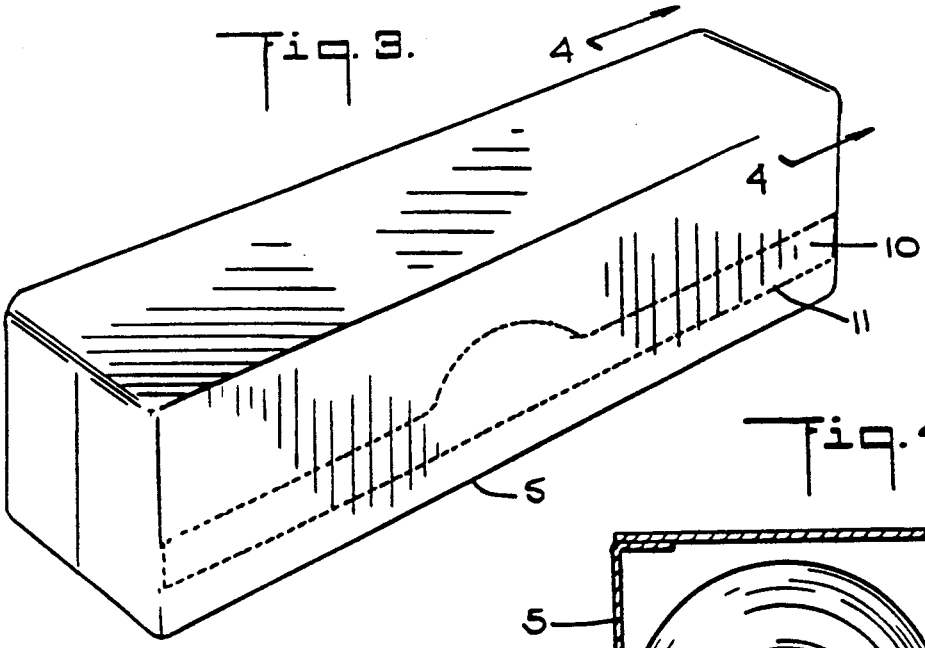
Fig. 4.
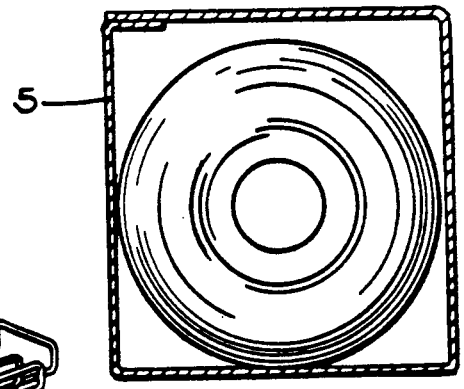
Fig. 6.
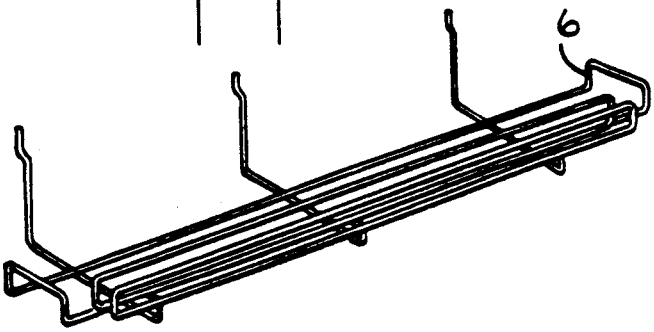
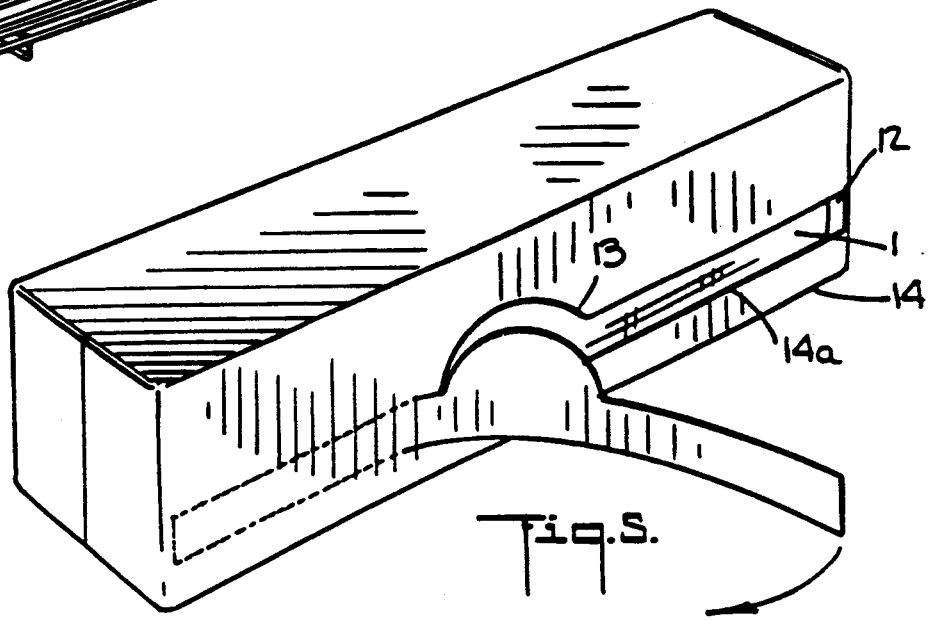
Fig. 5.

INSECT SCREEN DISPENSING SYSTEM INCLUDING A BOX AND SUPPORT ARRANGEMENT

This application is a continuation of prior application, Ser. No. 07/132,006 filed Dec. 11, 1987, now abandoned.

BACKGROUND OF THE INVENTION

This invention pertains to the field of holding, shipping, displaying and dispensing for sale in retail stores insect screen for use by individuals in repairing screen doors, screen windows and the like.

In the past such screen has been sold principally in two ways. One method of sale of the screen has been as pre-cut lengths about six feet long, rolled and tied into two-inch diameter cylinders as wide as the width of the screen, which typically is 24 to 48 inches.

Alternatively, the screen has been sold on large rolls with hollow centers containing for example about 640 feet of screen. The rolls may be displayed on pipes passed down their centers. The pipes act as axles on which the rolls turn and from which the screen may be unrolled and cut to desired lengths as needed.

The pre-cut rolls of short lengths involve obvious problems of waste, added expense in cutting and tying individually, and added bulk and delicacy, with consequent shipping, handling and displaying difficulties and expense. The large rolls designed for display on racks made of pipe overcome some of these problems but create other problems of their own. A major one is their tendency to unroll. Insect screen, particularly when made of aluminum, is stiff and tends to unroll of its own accord onto the floor when placed on a pipe axle. Ties or other means may be used to reduce this tendency, but they are bothersome, tend to be lost or not replaced, and hence are not entirely satisfactory. Moreover, such rolls are large and heavy; once one of them is started turning during removal of a short piece, its moment of inertia makes it keep unrolling beyond the desired amount. If one is not careful, excessive amounts will unroll causing additional work and perhaps damage to the screen.

With the increase of large convenience and home-repair stores, which emphasize a large selection of goods at discount prices, sometimes devoting a relatively small fraction of their space to hardware store items, it has become more and more important that the store owner be able to display items such as insect screen in a way that the customer can serve himself, or store staff with very little training in hardware goods can sell insect screen easily. These problems are compounded by the fact that most homeowners do not purchase insect screen on a regular basis, but largely do so only once every two or three years. Ideally, therefore, systems for display of insect screen should require as little attendance by store personnel as possible and also be as simple and foolproof as possible.

The opportunity to damage the screening goods or upset the display must be minimized.

Another drawback of display systems used with large rolls of insect screen is that they may not be adapted for the display of the pre-cut rolls. It is often desirable to be able to display and sell from large rolls in the spring when usage and sales are high, and then be able to sell the small pre-cut rolls at other times. The present pipe racks do not permit that flexibility.

SUMMARY OF THE INVENTION

The present invention is for a system and for a combination of elements for the shipping, storing, handling and dispensing of insect screen.

The invention comprises a cylindrical roll of insect screen of the kind already sold for use on pipe rack display systems, and a longitudinally extended box for containing the screen.

The box will typically have a square cross section, each side of the square being roughly equal to the diameter of the roll of screen. The box typically will be extended longitudinally sufficiently far to hold the width of the roll of screen. As such, the box may be used for shipping the screening from the factory to local retail stores.

A portion of one longitudinally extended side of the box is removable. When that portion is removed it leaves a slot which extends substantially the entire length of that side of the box. In addition, at least a portion of the slot is enlarged enough to permit easy entry of one's hand. The slot permits screening to be pulled out, to the extent needed, and cut. The enlarged portion permits one to turn the roll and locate the end initially and later to rewind any unneeded portions of the roll that may have been pulled out. In practice a few inches of the screen are left out so that the next user can readily pull out the amount of screen he or she needs.

The box is preferably placed so the slot is on one side of the box and in the horizontal direction. The roll should then be arranged in the box so that the screen runs from the bottom of the roll directly to the slot. If it is led from the top of the roll, the screen tends to roll toward the slot and bind in it.

We have found that despite the weight of the roll, and the great amount of friction to be expected from such weight and the uneven surface of insect screen, the insect screen may indeed be pulled from the box of this invention without undue physical effort by the individual and without damage to the screen or the box.

The system of this invention also comprises a support for the box which displays it at convenient heights, holds it firmly for removal of the screening, but does not obstruct the slot mentioned above.

We prefer that the slot be spaced away from the longitudinal corners of the box. This permits the support to hold the box at that corner without interfering with the slot. We believe it also adds to the strength of the box as a whole.

Corrugated cardboard is the preferred box material. For added strength we prefer that the corrugations be oriented perpendicular to the longitudinally extended sides of the box (that is, circumferentially), and that the box interior not have a silica finish of the kind often applied to the interior surface of such boxes to increase friction. This is usually done as a matter of course in shipping boxes to help hold the contents and reduce slippage, but in the case of the present invention it is undesirable.

The supports of the present invention may be adapted to hold cutting bars. Such bars are adapted to assist in cutting the screening. Typically the screening is pulled from the roll, pressed against two bars, and a knife is run across the screen between the bars.

We prefer that the cutter bars be located adjacent the box extending to just below the slot. With the screen being pulled from the bottom of the box over the lower edge of the slot, the screen is ideally located for easy cutting. Moreover, the cutter supports the lower edge of the slot for easy and smooth removal.

We prefer that the support be substantially deeper than the box itself such that, when the box is removed, the support can handle a reasonable number of pre-cut, approximately two inch diameter rolls of screen. (A support just deep enough to hold a box would hold an impractically small number of such pre-cut rolls.)

The box may also have an observational opening about one or two inches square through which the amount of screen remaining in the box, and the kind of screen in the box, may be readily observed by the customer.

The present invention also comprises the blank, as shown in the figures, from which the box may be made. The blank is generally rectangular in shape with four creases spaced at substantially equal intervals to permit bending of the cardboard into a longitudinally extended box having a square cross section. One of the box sides in the blank has a removable portion. Removal of that portion creates a slot which extends the entire length of one of the longitudinal sides of the box to be made from the blank. At least a portion of the slot is large enough to permit easy passage of a hand through the slot. The blank may include flaps at the end of the longitudinal sides which may be folded over to close the box, preferably locking with a tab to hold the ends closed in place. The blank may also include an observational opening, preferably of the removable kind, for observing the amount and kind of screen in the box.

The above described system of the present invention permits compact, efficient shipping of insect screen, and upon delivery to the retail store, display and dispensing of insect screen to customers in desired lengths. While on display in the store the system of this invention holds the screening well, without unwanted unrolling. The exact amount required can be readily cut and sold without wastage. Moreover, the box surfaces have a neat appearance and provide space for advertising and instructions.

BRIEF DESCRIPTION OF THE DRAWINGS

FIG. 3 is a three-quarter view of the box of the present invention.

FIG. 4 is a cross-section of FIG. 3.

FIG. 5 is a three-quarter view of the present invention showing removal of a portion of the box to create a slot.

FIG. 6 is a three quarter view of a support of the present invention.

DESCRIPTION OF PREFERRED EMBODIMENTS

Figure 1:
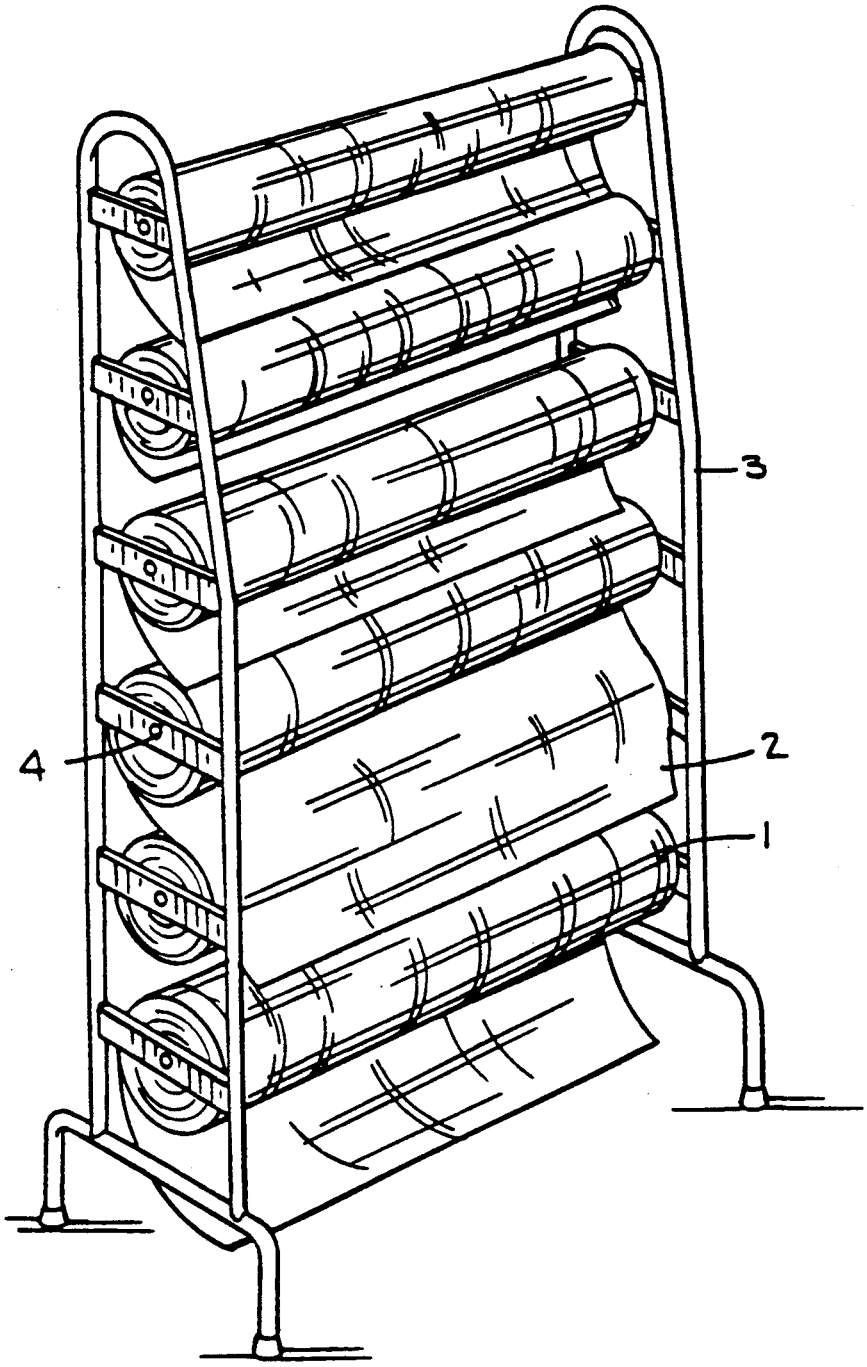
Fig. 1. PRIOR ART
FIG. 1 is a three-quarter view of a pipe-rack system of the prior art. Not shown is a cutter bar which such systems sometimes had.

In prior art FIG. 1, several rolls 1 of insect screen 2 are shown on a frame 3 in which pipes 4 are passed through the centers of the rolls. Standard rolls hold about 164 feet of screen and weigh about 8.5 pounds (24" wide fiberglass) to 23.5 pounds (48" wide aluminum). Such a frame may be placed in a retail store for display and dispensing of insect screen. Insect screen is typically made of aluminum or coated fiberglass strands woven into a fabric, about 24 to 48 inches wide with small openings between the strands.

Figure 2:
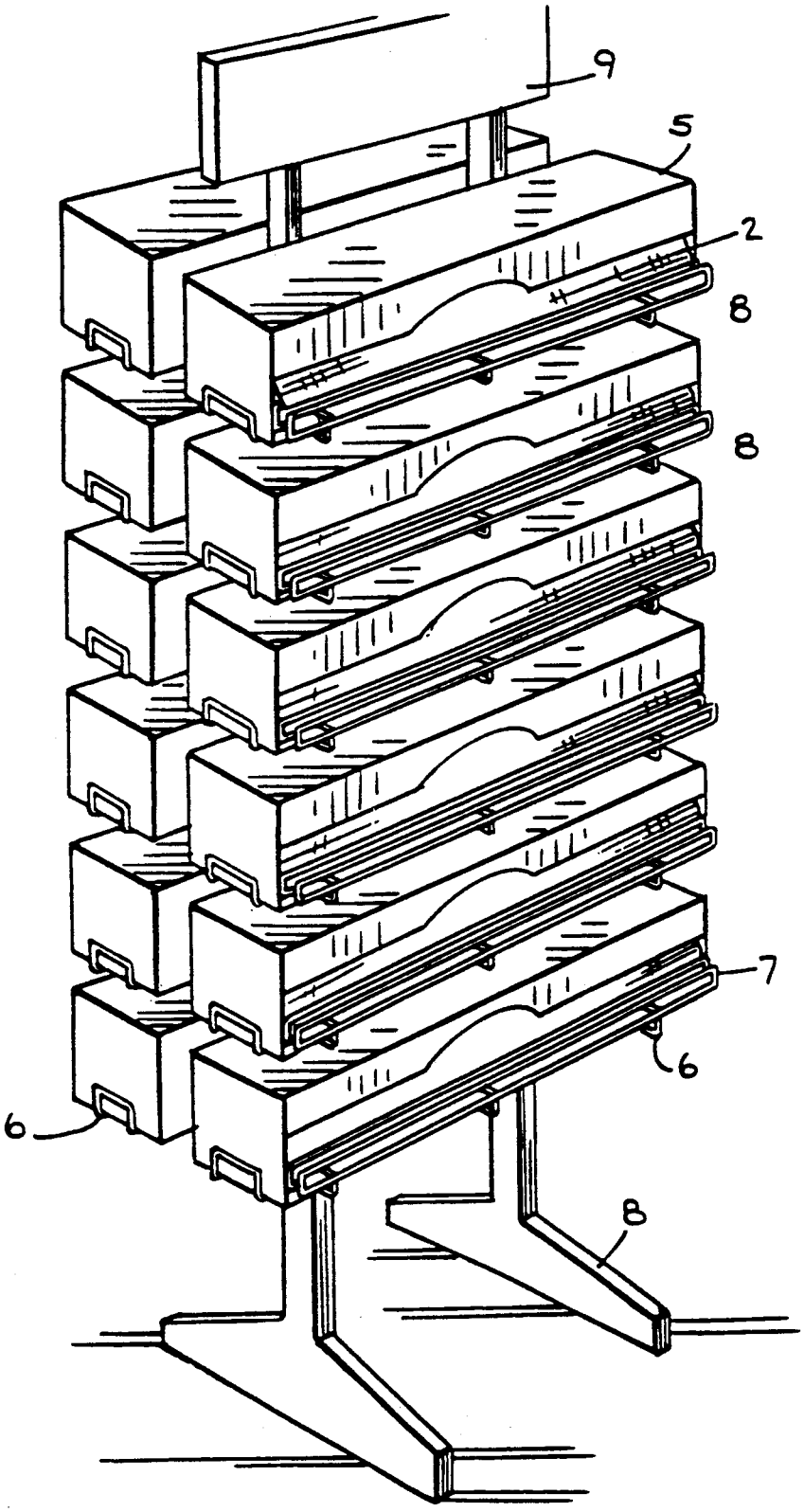
FIG. 2 is a three quarter view of one embodiment of the system of the present invention.

In FIG. 2, a preferred embodiment of the present invention, insect screen 2 is dispensed from boxes 5 held by support 6, having cutter bars 7, on a frame 8. Advertising and instructions for use may be placed on the boxes, on the cutter bars, and on the display board 9. These boxes 5 are about 7½ inches on a side, about 24 to 48 wide, and hold a standard 164 foot roll.

FIG. 3 shows a box 5 before removal of a portion 10 of a side of the box. The box is about 7½ inches on each of its sides and about 36" long. FIG. 3 also shows perforations 11.

FIG. 5 shows removal of portion 10 to form a slot 12. The slot 12 extends substantially the entire length of one of the longitudinally extended sides of the box and has a portion 13 which is enlarged. The lower edge 14A of the slot in FIG. 5 begins about ⅞ inch from the lower longitudinally extended corner 14. For most of its length slot 12 is about 2 inches wide. The portion 13 is about 3¼ inches across vertically and about 6 inches from side to side.

Figure 8:
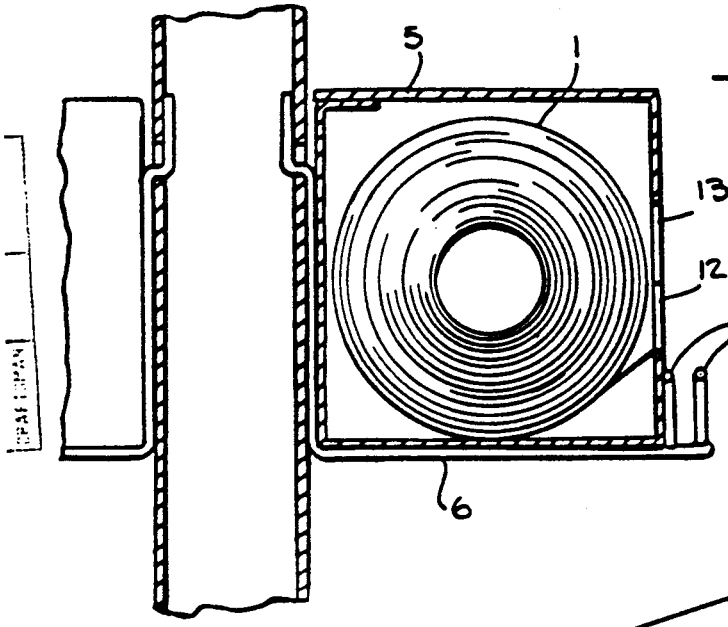
FIG. 8 is a cross-section of a portion of FIG. 2.

FIG. 6 shows in detail a support 6 having cutter bars 7 (shown in detail in FIG. 8).

Figure 7:
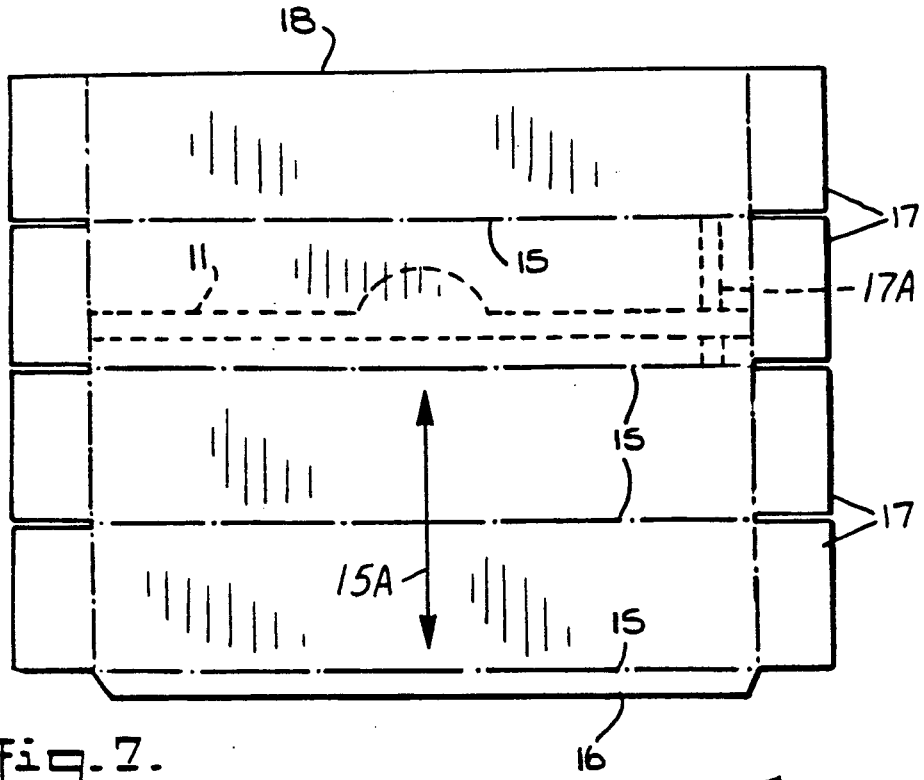
FIG. 7 shows the blank of the present invention.

FIG. 7 shows a blank for the box of this invention. In addition to portions already described, FIG. 7 shows four creases 15 spaced at substantially equal intervals to permit bending the blank to form a square longitudinally extended box. It also shows a tab 16, which can be adhered to the portion 18 to create a box, and end flaps 17, which fold inwards to close the ends of the box. Arrow 15A represents the direction of corrugations running the preferred direction; that is, circumferentially and perpendicular to the longitudinally extended dimension of the sides of the box. Perforations 17A for a removable observational opening are also shown in FIG. 7. We prefer to use approximately 175B test flute corrugated cardboard and its equivalents.

FIG. 8 shows in detail the cutter bars 7, one of which is adjacent to and preferably against the box, thus holding it firmly. The cutter bars are about ¾ inches high and hence about ⅛ inch below the lower edge of the slot 14A.

Figure 9:
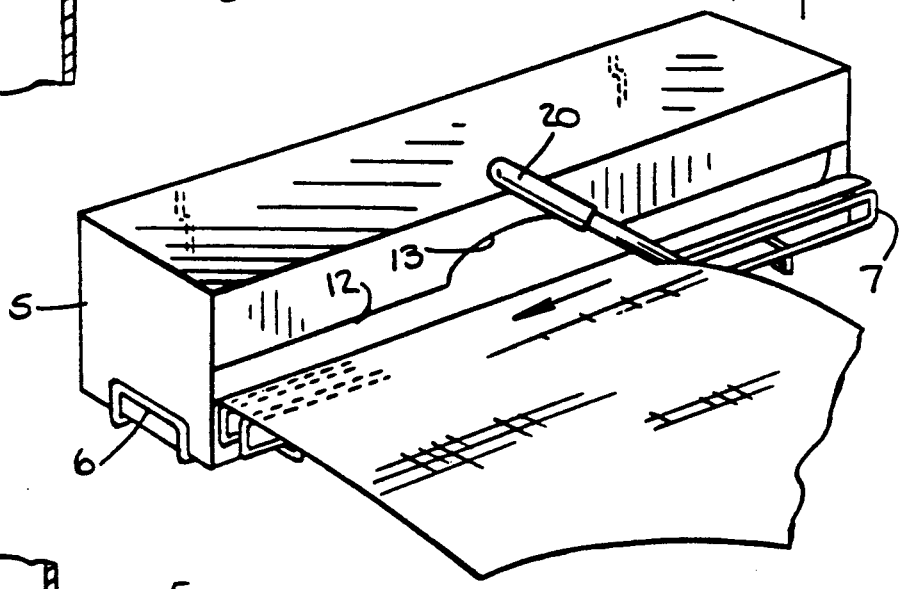
FIG. 9 is a three quarter view showing the use of the cutter bar of a preferred embodiment of the present invention.
Figure 10:
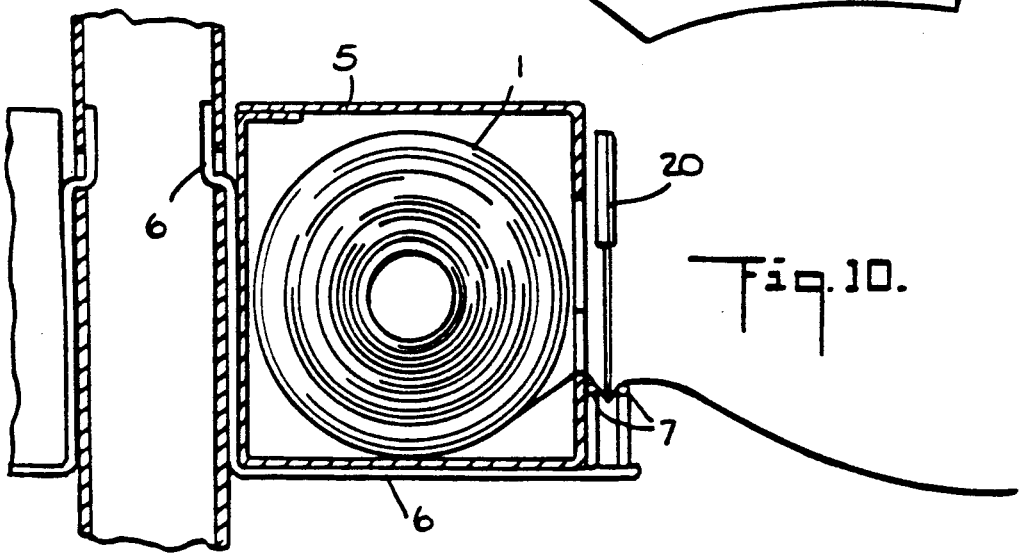
FIG. 10 is a cross-section of FIG. 9.

In FIGS. 9 and 10, a knife 20 is shown used with cutter bars 7 to cut screen 2. FIG. 10 also shows a preferred embodiment in which the screen is led directly from the lower portion of the roll to the slot, rather than directly from the upper portion of the roll to the slot.

Figure 11:
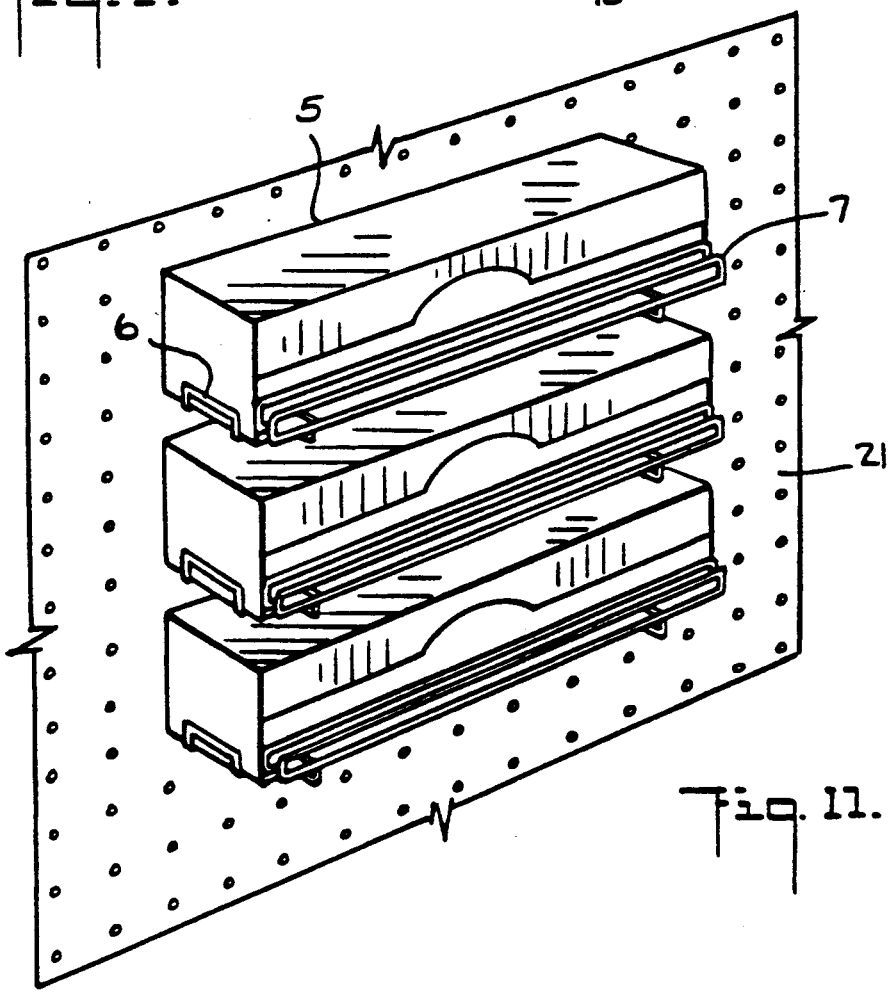
FIG. 11 is a three-quarter view of another embodiment of the invention.

Supports 6 of the present invention may be placed on their own frame, as in FIG. 2, or hung on peg board 21, as shown in FIG. 11.

Figure 8A:
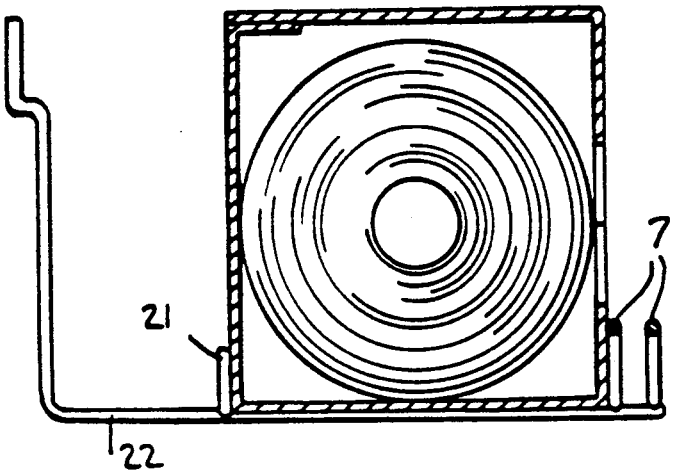
FIG. 8A is a cross-section showing a preferred embodiment of a box and support of the present invention.
Figure 8B:
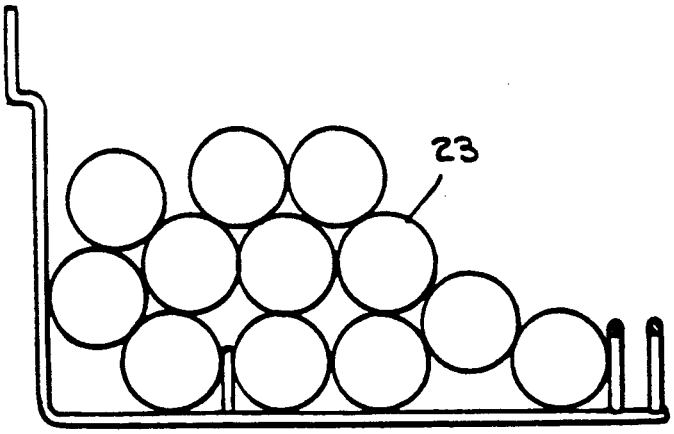
FIG. 8B shows the support of FIG. 8A in an alternate use.

An alternate preferred embodiment of the hanger 6 is shown in FIGS. 8A and 8B. There, the horizontal portion of the support 6 is about 10½ inches (instead of the approximately 7½ inch length shown in FIG. 8) and a rear box positioner 21, about 2 inches high, is added about 7½ inches from cutter bars 7. The other elements of the support already described act as before, but the additional portion 22 makes it possible for hanger 6 to hold a number of 2-inch diameter pre-cut rolls 23 when the box 5 is removed, as shown in FIG. 8B. Without additional portion 22, the capacity of the support 6 in this alternate use for 2-inch diameter rolls would be too small. The extended support of FIGS. 8A and 8B therefore makes possible two alternate uses with the same support equipment.

The above description is exemplary of preferred embodiments. Other variations of the invention are covered by the following claims, which are intended to define the scope of the invention.

We claim:

1. A system for dispensing screen comprising:

a roll of screen;

a longitudinally extended box containing the roll, the box possessing sufficient strength to prevent uncoiling of the roll and having a longitudinally extended horizontal bottom wall and a longitudinally extended vertical front wall;

a longitudinal slot extending substantially the entire longitudinal length of the front wall;

the roll being principally supported by the bottom wall of the box abutting the bottom of the roll;

the roll being arranged so that screen may be directly led from the bottom of the roll to the slot; and a support replaceably supporting the box, said support comprising a mounting frame element abutting the vertical front wall of the box adjacent the longitudinal slot and at least one bar means for assisting in cutting the screen, said bar means comprising two cutter bars, one of which is arranged against the box and adjacent to the lower edge of the slot and the other of which is arranged parallel to the first cutter bar and is located away from the first cutter bar, the two cutter bars being arranged and constructed with respect to the slot and to each other such that they assist in cutting screen when screen is laid across the bars and a knife is run across the screen.

2. A system for dispensing insect screen, the system comprising:

a plurality of segments of insect screen, each segment being individually coiled into a substantially cylindrical roll of screen;

a plurality of longitudinally extended boxes, each box for containing a respective said roll of screen and for dispensing screen therefrom, each box having longitudinally extended horizontal bottom and top walls, a longitudinally extended vertical front wall and a longitudinally extended vertical rear wall, and two end walls;

a longitudinal slot in each box formed by removing a portion of the front wall thereof, the slot extending substantially the entire longitudinal length of the front wall;

a respective said roll of screen being contained in and being completely supported by a respective said box, the roll of screen abutting the bottom of the box, the roll of screen being arranged within the box so that screen is directly led from the bottom of the roll to the slot for dispensing thereof, a bottom edge of said slot being disposed above said bottom wall and below a central axis of said roll of screen; and a respective support replaceably supporting each respective box, each support comprising at least one mounting frame element for supporting the bottom of the box and at least one mounting frame element abutting the front wall of the box adjacent the longitudinal slot for supporting the front of the box; and the screen being dispensed from a respective said box through the slot in the front wall thereof and proximate the mounting frame element abutting the vertical front wall of the box.

3. The system of claim 2, wherein the at least one mounting frame element for supporting the bottom of each box runs substantially the entire length of the bottom of the box, the at least one mounting frame element for supporting the front of the box runs substantially the entire longitudinal length of the front wall of the box, and said support further comprises at least one mounting frame element abutting each of the two end walls of the box for supporting the end walls.

4. The system of claim 2, in which the slot is spaced from the longitudinal corners of the front wall of each box.

5. The system of claim 2, in which each box is made from corrugated cardboard and the corrugations are perpendicular to the longitudinally extended sides of the box.

6. The system of claim 2, in which each box is made of cardboard and is free of silica-based finish applied to the interior of the box.

7. The system of claim 2, each support further comprising means for supporting and displaying pre-cut small rolls of short pieces of insect screen.

8. The system of claim 2, in which each mounting frame element supporting the front of each box comprises two cutter bars, one of which is arranged against the box and adjacent to the lower edge of the slot, and one of which is spaced from the first to assist in dispensing the screen.

9. The system of claim 2, in which each box further comprises an observational opening for observing the amount and kind of screen inside the box.

10. A system according to claim 2, wherein each roll of screen has a propensity toward uncoiling of its own accord, and wherein each box has sufficient strength to prevent uncoiling of the roll of screen arranged therein.

11. A combination for shipping insect screen and for cooperating with a support and with a mounting frame element to dispense said screen, the combination comprising:

a segment of insect screen, the segment being coiled into a substantially cylindrical roll of screen;

a longitudinally extended box for containing the roll of screen and for dispensing screen therefrom, the box having longitudinally extended horizontal bottom and top walls, a longitudinally extended vertical front wall and a longitudinally extended vertical rear wall, and two end walls;

a removable portion extending substantially the entire longitudinal length of the front wall of the box, which upon removal leaves a slot, a bottom edge of said slot being disposed above said bottom wall and below a central axis of said roll of screen;

the roll of screen being contained in and being completely supported by the box, the roll of screen abutting the bottom of the box and being arranged within the box so that screen is led directly from the bottom of the roll to the slot for dispensing thereof; and the box cooperating with a support and the vertical front wall of the box cooperating with a mounting frame element of the support, the front wall resisting forces applied to the roll and the box during dispensing of the screen while the box is on the support and the front wall is adjacent the mounting frame element.

12. The combination of claim 11, in which the removable portion of the front wall leaves a slot located away from the lower longitudinal corners of the front wall.

13. The combination of claim 12, wherein the support comprises at least one mounting frame element running substantially the entire length of the bottom of the box for supporting the bottom of the box, at least one mounting frame element running substantially the entire longitudinal length of the front wall of the box and abutting the vertical front wall of the box adjacent the longitudinal slot for supporting the front of the box, and at least one mounting frame element abutting each of the two end walls of the box for supporting the sides of the box, the screen being dispensed from the box through the slot in the front wall thereof and proximate the mounting frame element abutting the vertical front wall of the box.

14. A combination according to claim 11, wherein the roll of screen has a propensity toward uncoiling of its own accord, and wherein the box has sufficient strength to prevent uncoiling of the roll of screen.

* * * * *